United States Patent [19]

Bingold

[11] Patent Number: 4,910,831

[45] Date of Patent: Mar. 27, 1990

[54] TWO-LOOP LAW ENFORCEMENT RESTRAINING DEVICE FORMED FROM A SINGLE, FLAT STRAP

[76] Inventor: Richard F. Bingold, P.O. Box 898, Newport, Vt. 05855

[21] Appl. No.: 365,318

[22] Filed: Jun. 13, 1989

[51] Int. Cl.[4] ..... E05B 75/00; B65D 63/00

[52] U.S. Cl. ..... 24/16 PB; 128/878; 70/16

[58] Field of Search ..... 24/16 PB, 17 AP; 70/16; 128/878, 882

[56] References Cited

U.S. PATENT DOCUMENTS

| | | | |
|---|---|---|---|
| 3,146,614 | 9/1964 | Von Frantrius | 70/16 |
| 3,892,011 | 7/1975 | Kohke | 24/16 PB |
| 3,918,048 | 9/1976 | Moody et al. | 24/16 PB |
| 4,071,023 | 1/1978 | Gregory | 128/878 |

FOREIGN PATENT DOCUMENTS

| | | | |
|---|---|---|---|
| 502501 | 11/1954 | Italy | 70/16 |

*Primary Examiner*—Victor N. Sakran

*Attorney, Agent, or Firm*—Parmelee, Bollinger & Bramblett

[57] ABSTRACT

A positive, secure two-loop restraint for law enforcement is light-weight, strong, inexpensive and disposable and which may be attached to the wrists or ankles to be used in place of traditional handcuffs. The restraint is formed from a single elongated, substantially flat plastic strap having a pair of closely spaced socket clasps centrally located therein generally mid-way between first and second strap extremities. The extremities are insertable through openings in the socket clasps which are perpendicular to the plane of the strap and when receiving the extremities form double loops with the strap ends extending parallel to each other when the loops are formed by positioning the extremities through the socket clasps. Each of the extremities has a toothed surface whose teeth all slope in the same direction, and each socket includes a latch stop extending in the same direction as the slope of the teeth for permitting the stop to ride over the teeth during insertion movement and preventing extraction movement, thereby providing a flat ratchet arrangement such that a two-loop restraint is provided, with the sizes of the loops being adjustable in the same direction and which are formed and positioned on wrists or ankles of the restrained person when the extremities are inserted in the same direction through the socket clasps. The straps are made of a high density plastic, are light-weight and a large number may be conveniently carried by a law enforcement user as contrasted with bulky, expensive, heavy and difficult to use handcuffs.

20 Claims, 2 Drawing Sheets

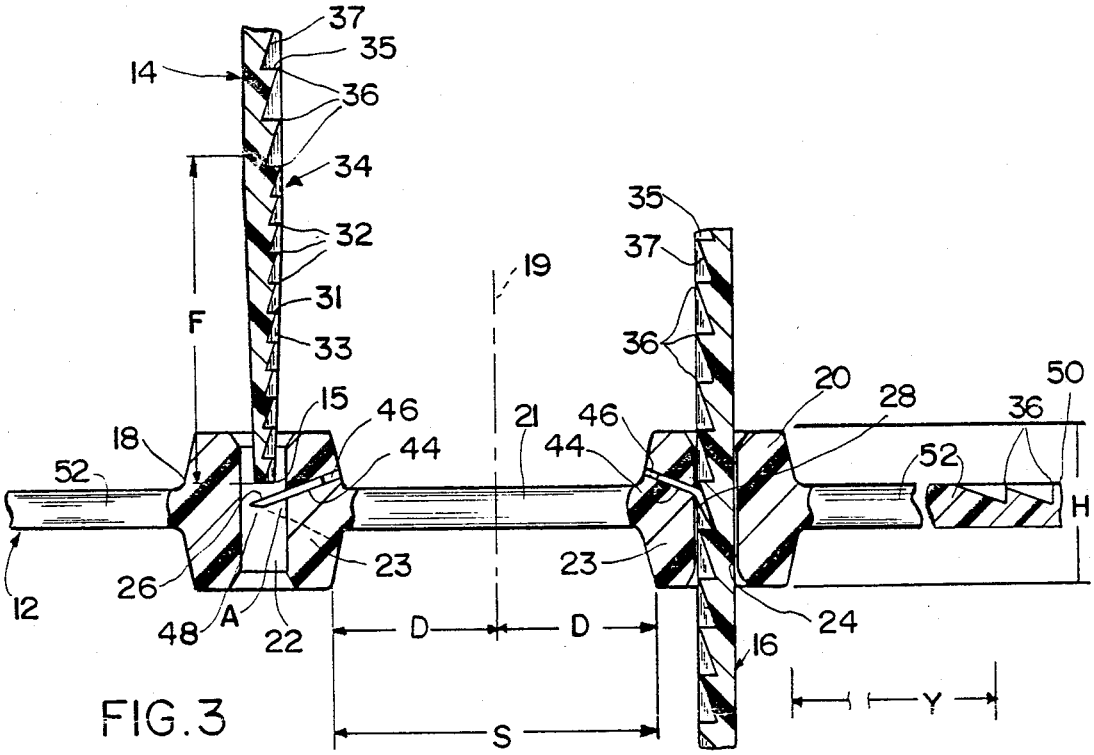
FIG. 3
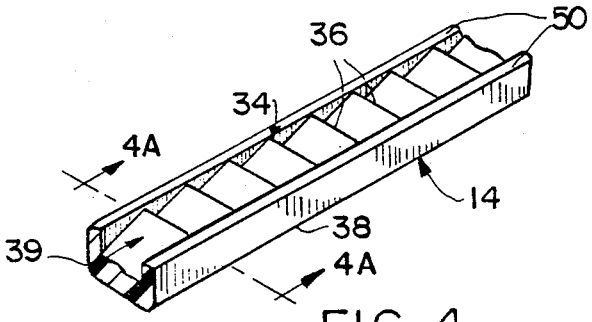
FIG. 4
FIG. 4A
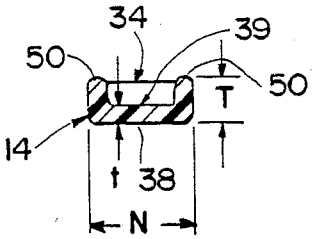
FIG. 5
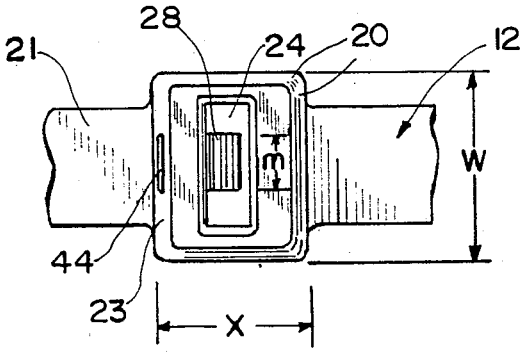

TWO-LOOP LAW ENFORCEMENT RESTRAINING DEVICE FORMED FROM A SINGLE, FLAT STRAP

BACKGROUND OF THE INVENTION

This invention relates to law enforcement restraining devices and more particularly to a disposable, double-loop restraining device formed from a single, elongated, flat strap of plastic which is removed from the person or animal being restrained by cutting the strap off or snipping it off.

The conventional restraining device used by law enforcement officers and others consists of a pair of connected metal rings that can be locked about the wrists of a prisoner to keep him from using his hands or to fasten him to the law enforcement officer or some other object such as a fence or a post or attachment to an anchoring member in a transport vehicle. These conventional handcuffs require a key, are bulky and the oval opening defined, though adjustable in length, is typically not adjustable in width for different thicknesses of wrists or ankles. In addition, when multiple arrests are involved multiple sets of handcuffs may be required which burden the officers with carrying a plurality of rather difficult to handle and heavy metallic objects. In addition, in law enforcement work which requires handling of individuals for transporting and transferring from one facility to another, processing, bookings, etc., the prisoners are normally turned over from one officer or agency to another requiring one set of hand-cuffs to be removed and given back to the first officer (who is transferring the prisoner to a second officer) and for the application of a different set of handcuffs provided by the transferee. Any change, or removal and replacement of the restraining devices on a prisoner is dangerous and provides an avenue of opportunity for the prisoner to injure an officer or escape while such transporting transfers are being made.

Moreover, since a key is necessary to remove conventional handcuffs, the transporting or arresting officer may be assaulted in attempts to obtain the key. In other words, the use of the conventional, expensive, key-opened handcuffs as restraining devices provide a plurality of problems and risks when they are both applied and removed from the party or parties to be restrained thereby.

U.S. Pat. No. 4,071,023 addresses some of the aforesaid problems of conventional, key-operated, heavy, expensive handcuffs. A four-legged-shaped restraining device is provided which is molded from a material such as a resinous plastic and has four leg portions extending outwardly in three different directions. One of the problems with this particular device is its complex four-legged shape in which the respective socket bore each parallel with a respective leg is located at the end of a leg so that the two socket bores are oriented perpendicular to each other. It is difficult to insert a flexible leg into a socket bore at the end of another flexible leg. Moreover, this four-legged structure results in an awkward closed position in which the ends inserted in the bores project out at different angles making the device difficult to operate and to use. This four-legged arrangement is bulky and difficult to store and use.

SUMMARY OF THE DISCLOSURE

Accordingly, it is an object of the present invention to provide a new and improved law enforcement device which is easy to use, easy to operate and store and is less complex than prior art types of restraints.

A further object of this invention is to provide a novel and improved, simple, two-loop law enforcement restraining device which facilitates restraining individuals alone or in a group, the handling of individuals for the transportation transfer from one facility to another and during the processing of the restrainees with no risk involved which would be required in removing and replacing conventional handcuffs from one officer to the next in such operations.

Still another object of this invention is to provide a new and improved two-loop law enforcement restraining device which facilitates the restraint and movement of multiple subjects.

Still a further object of this invention is to provide a new and improved two-loop law enforcement restraining device which is simple to operate, is light-weight, inexpensive and disposable and may be safely applied and is not key-operated.

Another object of the present invention is to provide a new and improved two-loop law enforcement restraining device which reduces the risk in handling prisoners that might otherwise subject the law enforcement officers to repeated contact or close association with prisoners who might have acquired immune deficiency syndrome or AIDS-related conditions.

In carrying out this invention in one illustrative embodiment thereof a law enforcement restraining device of the double-loop type for attachment around the wrists or ankles of the restrained person comprises a single elongated, substantially flat strap having first and second strap extremities which are adapted to be inserted and retained in first and second spaced socket clasps centrally located in the strap between the extremities. The first and second socket clasps have openings therethrough substantially perpendicular to the plane of the elongated strap which are adapted to receive and retain the first and second extremities of the strap when those extremities are looped and inserted into the socket clasps, whereby the first and second strap ends project parallel to each other when positioned through the first and second socket clasps. The first and second strap extremities each have a toothed surface thereon whose teeth slope in the same direction A latch stop is provided in each socket extending in the same direction as the slope of the teeth for permitting insertion movement while preventing extraction movement in the opposite direction thereby providing a flat ratchet arrangement, whereby a two-loop restraint is provided with the size of the loops being adjustable toward smaller size. The flat restraining strap is light-weight, inexpensive and disposable and can only be removed from the restrained person by cutting it off or snipping it off.

BRIEF DESCRIPTION OF THE DRAWINGS

The invention, together with further object,, aspects, features and advantages thereof will be more clearly understood from a consideration of the following description taken in connection with the accompanying drawings in which like elements bear the same reference numerals throughout the various views.

FIG. 3 is an enlarged partial sectional view illustrating the two socket clasps. One end of the strap is shown being inserted into one of the socket clasps, while the other extremity of the strap is shown fully-inserted into the other socket clasp.

FIG. 4 is an enlarged perspective view of a portion of an extremity of the strap of the law enforcement restraining device in accordance the present invention.

FIG. 4A is a cross section on line 4A—4A of FIG. 4.

FIG. 5 is an enlarged top plan view of one of the socket clasps as seen at the right center in FIG. 1, without the strap extremity being shown in the opening of this socket clasp.

DESCRIPTION OF THE PREFERRED EMBODIMENTS

The law enforcement restraining device referred to herein has no need for a key to unlock either loop once it has been applied around the wrist or ankle of a restrained prisoner for it is comprised of a simple straight flexible plastic strap, is disposable and is cut for removal. The straight strap restraining device is bent for forming two loops adapted to restrain either humans or animals and is attached to limbs such as arms and legs in the vicinity of the wrists and ankles, respectively.

Among the advantages of the light-weight device are those resulting from the fact that a law enforcement officer can easily carry a plurality of them, and these flexible, straight strap restraints can readily be looped around each other in numerous ways for being coupled together with one or more of the loops being attached to the same or other individuals or animals, and such coupling may include anchoring one of the loops to a stationary member such as a post, pipe, fence or other object or to an anchoring member in a transport vehicle. The restraining device referred to herein will not require a key or other unlatching element and is inexpensive and disposable in that once it has been applied, it is removed by simply cutting or snipping it from the person being restrained.

Figure 1:
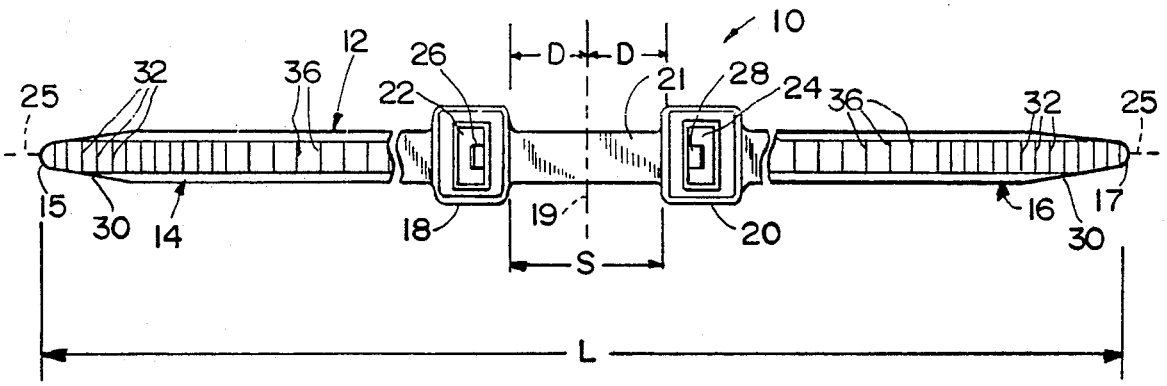
FIG. 1 is a top plan view of the straight strap law enforcement restraining device in accordance with the present invention.

Referring now to FIG. 1, the law enforcement restraining device embodying the present invention is referred to generally by the reference numeral 10 and comprises a single, elongated, integral substantially flat straight strap 12 having a broad shallow U-shaped cross section and having first and second strap extremities 14 and 16, respectively, with respective rounded tips 15 and 17. The strap 12 is preferably molded of a light-weight, strong, tough, stiffly flexible, high density poly plastic material. This tough strap can be cut with a pair of large cutting snips or large cutting shears, but such cutting is not easily done. The strap 12 contains first and second closely spaced socket claps 18 and 20, respectively, which are centrally located in the strap 12 midway between the first and second tapered tips 15 and 17. It is to be noted that this law enforcement restraint 10 is symmetrical about a transverse centerline 19 (FIG. 1), an thus the closely spaced socket clasps 18 and 20 are each located the same relatively small distance "D" on either side of this centerline 19. There is a bridging portion 21 of the straight strap 12 which spans between and is integral with the mesial portions 23 of the respective socket clasps for strongly and securely interconnecting these socket clasps. This restraint 10 is also advantageously symmetrical about a longitudinal centerline axis 25 (FIG. 1) so that it is conveniently reversible end-for-end when being applied by the officer. In other words, the officer need not waste time in checking which tip 15 or 17 is to be inserted first, because of the advantageous symmetry of this useful tool 10.

Figure 2:
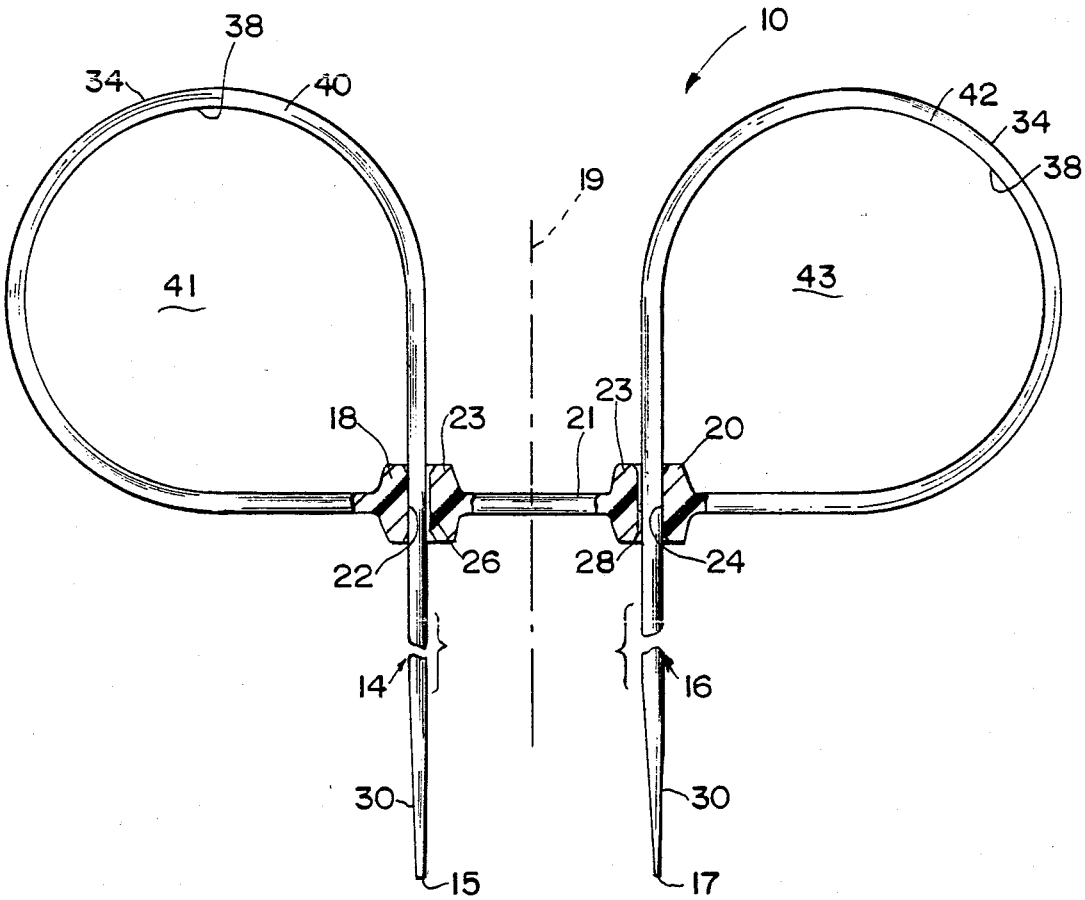
FIG. 2 is a side-elevational view of the law enforcement restraining device illustrated in FIG. 1 showing how the two extremities of the straight strap are bent and inserted through the socket clasps for forming a two-loop restraining device in accordance with the present invention.

The first and second spaced socket clasps 18 and 20 have central openings 22 and 24, respectively, extending therethrough which openings are substantially perpendicular to the plane of the elongated straight strap 12 as will best be seen in FIGS. 2 and 3. As will be seen in FIG. 3, the socket 18 includes a downwardly extending latch stop 26 which is inclined downwardly in the direction away from the centerline 19. This latch stop 26 projects into the opening 22 of the socket 18 for a latching reason which will be explained hereinafter. The other socket 20 also includes a downwardly inclined latch stop 28 which projects downwardly in the direction away from the centerline 19 into the opening 24 of the socket 20. These latch stops 26 and 28 are anchored in the mesial portions 23 of the socket clasps.

As best seen in FIG. 3 the first extremity 14 of the strap 10 includes a tapered end portion 30 extending inwardly from the rounded tip 15 to the main body of the extremity 14 of the straight strap 12. This tapered end portion 30 plus a short contiguous region of the extremity 14 include a plurality of small ridges 32 extending transversely with respect to the longitudinal centerline 25. These small ridges 32 have a saw-tooth configuration as seen in an axial sectional view in FIG. 3 with their abrupt faces 31 being on the mesial surface of each ridge and with their sloping faces 33 being on the distal surface of each ridge. These small saw-tooth ridges 32 cover a length "F" (FIG. 3) adjacent the rounded tip 15. For example, this length F is in the range from about one inch to about 2 ½ inches and preferably is about 1 ½ to about 2 inches. The purpose of this saw-toothed length F is to provide a high frictional grip by an officer when pulling on the saw-toothed length F after the tapered end portion 30 has been inserted fully through the socket opening 22 for enabling firm manual pulling of the strap extremity 14 through the socket clasp 18. Immediately contiguous to the length F, having the small saw-tooth ridges 32, extends a toothed channel surface 34 having larger saw-tooth ridges 36 which slope in the same direction as the smaller ridges 32 near the tapered end. Thus, these larger saw-tooth ridges have abrupt medial faces 35 and sloping distal faces 37.

As seen in FIGS. 4 and 4A, the strap extremity 14 has a broad trough-shaped (broad U-shaped) configuration forming a channel 39 in which is located the saw-toothed surface 34. The broad flat surfaces 38 of the extremities 14 and 16 of the strap 12 are considered the "bottom" or "inward" surfaces, because such surface 38 is intended to face inward toward the wrist or ankle of the restrained person. Conversely, the surface containing the channel 39 is considered the "top" or "outward" surface, and this top surface must face the latch stop 26 for it to engage against the abrupt mesial ridge faces 35 for latching the strap extremity 14 in its closed loop position as shown in FIG. 2.

The second extremity 16 of the strap 12 is constructed in the same manner as the first extremity 14, except that this second extremity is the symmetrical mirror image of the first extremity. FIG. 5 more fully illustrates the structure of the socket clasp 20 which has a central opening 24 and a downwardly inclined latch strap 28 projecting into the central opening and which is adapted functionally to contact the teeth 36 of the saw-toothed channel surface 34 to retain the strap extremity 16 within the socket clasp 20 once it has been inserted therein and pulled into the final looped configuration 42 (FIG. 2).

In operation of the restraining device of the present invention it will be seen in FIG. 2 that the first extremity 14 is flexed with its bottom surface 38 facing the wrist or ankle or other object being encircled to form a loop with its tapered end portion 30 being inserted into the socket clasp 18 in order to be pulled therethrough to form a first loop 40. Then, the second extremity 16 of the strap 12 is looped in the opposite direction and inserted into the socket clasp 20 to form a second loop 42. The closely spaced positioning "S" of the spaced clasps 18 and 20 serves to restrain the person whose ankles or wrists are in the respective loops 40 and 42. Moreover, since the strap extremities 14 and 16 are stiffly flexible, they can be flexed as may be desired or required for configuring into various shapes and sizes of loops for snugly and accurately conforming to the perimeter of the encircled ankle, wrist or other anchoring object. In addition, there can be the same or different sizes of loops. The looping arrangement is simple and the flexing direction is conveniently inwardly toward the transverse centerline 19, thereby insertion of the tapered end portions 30 into the sockets is easy to do and quickly restrain a person.

When the respective tapered portions 30 are inserted into and through the respective socket clasps 18 and 20 then the first and second extremities 14 and 16 project through their respective sockets parallel to each other and so it is relatively easy to pull the loops 40 and 42 to be the same size if so desired by visually aligning the tip ends 15 and 17 of the extremities 14 and 16, after they have been pulled through their respective socket clasps.

As will clearly be seen in FIG. 3, the rounded tip 15 and tapered end portion 30 of the first extremity 14 is shown being inserted into the socket to be pulled through its socket clasp 18. Each strap end 15, 30 and 17, 30 is shaped for ease of insertion into a socket opening. As shown with respect to the latch stop 28 in socket clasp 20, each latch stop is inclined in the same direction as the distal sloping faces 37 of the saw-tooth ridges 36 and each latch stop is resiliently deflectable permitting the latch stop to ride over the ridges 36 in the upward direction of their slopes during insertion but preventing extraction movement, thereby providing a flexible strap ratchet arrangement, which makes the size of a loop 40 or 42 adjustable in the sense that the loop configuration 41 or 43 can always be made smaller until the limit "Y" (FIG. 3) as provided by the toothed channel surface 34 and its extent on each strap extremity. The strap has a smooth portion 52 of length Y near each socket clasp where the toothed channel shape 34 is intentionally omitted.

By virtue of the fact that the socket clasps 18 and 20 are integral with the strap 12 and are located near the transverse centerline 19, the flexing direction is conveniently inwardly for forming both loops 40 and 42 with the tips and tapered end portions 15, 30 and 17, 30 after insertion becoming parallel with each other as seen in FIG. 2. The resulting dual-loop configurations 41, 43 are advantageously symmetrical about the centerline 19 in FIG. 2, making the installation job easy for the officer, because the left and right loops are symmetrically the same regardless of which one is applied first and regardless of whether the rounded tip 15 is at the left or right, because the overall strap 12 is completely symmetrical about both its transverse an longitudinal centerlines 19 and 25, thus advantageously being fully reversible end-for-end without altering its functional operation.

Accordingly, in use the extremities 14 and 16, after being availably inserted through their respective socket claps 18 and 20, are readily pulled farther through their respective sockets forming loops 41 and 43 encircling the arms or legs of the restrained person. The extremities are pulled through by grasping the friction region F to adjust to the size of the loop to match the specific limb, wrist, ankle, post, etc., which the loop 41 or 43 is encircling. Although the double-loop configuration 41, 43 as illustrated in FIG. 2 shows the downward insertion of the extremities 14 and 16 through their respective socket clasps 18, 20, the strap 12 can be turned over if desired by the officer so that, the insertion can be in the upward direction, thereby forming an inverted symmetrical dual-loop configuration as will be seen by inverting FIG. 2. Accordingly, it is difficult to make a mistake, as this useful, disposable restraining tool 10 can be used to form a double-loop configuration 41, 43 in either direction and starting with either end. After the loops 41 and 43 have been pulled snug, the end portions of the extremities can then be snipped off as being no longer needed.

The latch stops 28 and 26 are made preferably of flatstrip, stiff spring steel, and each one is inserted inclined downwardly through a narrow slot 44 (FIG. 5) of the mesial portion 23 in each molded socket. Thus, the ratchet effect is created by the stiff but flexible metal latch stop. After this latch stop 26 or 28 (FIG. 3) has been installed in its slot 44, the upper end of the slot is plugged or sealed at 46 by strongly bonded plastic for preventing the latch stop from being pushed backwardly out of its slot 44, regardless of how forcefully the restrained person may strain against the encircling loop configurations 41, 43. The ratchet end 48 (FIG. 3) of each latch stop is shaped, for example by grinding, to have a flat surface which is pitched at an acute angle "A" (FIG. 3) to the length of this spring steel strip.

Accordingly, a positive, secure, restraint for law enforcement services and others is provided which is light-weight and can be used encircling various limbs or anchoring inanimate members to restrain people or animals for replacing the traditional handcuffs. The device is in the form of a flat strap which permits easy transportion and enables an officer or other agent to carry ten or twelve of these useful tools without burdening the officer with extra weight to restrict mobility.

The restraining device 10 is particularly useful for law enforcement officers and agencies but may be employed as well by others in restraining individuals or animals alone or in a group. The restraining device is well adapted for handling individuals for transportation transfer from one facility to another and during processing, bookings and other due process legal procedures required by law. When employing the convenient restraining device embodying the resent invention there is reduced risk to the officers of prisoner escape or injury by a prisoner, which can occur when prior art restraining devices such as heavy metal handcuffs are removed and replaced during exchange of custody in the aforesaid procedures. One officer may transfer the prisoner or subject to another without the risk which is involved when expensive prior art handcuffs are required to be removed and replaced by other handcuffs, which are under the jurisdiction of the transferee.

The advantages provided by the illustrative embodiment of the present invention include the following:

1. It can be employed in place of handcuffs by any law enforcement agency for restraining individuals alone or in a group.

2. By virtue of this, dual-loop symmetrical strap restraint being inexpensive and disposable and light in weight, a first officer can readily afford to transfer a prisoner to a second officer, while leaving the restraint installed on the prisoner, because the first officer will have available several more of these restraints. (whereas an officer today is likely to possess only one pair of key-operated handcuffs and cannot relinquish possession of the only restraint available, in case another situation might arise during the present tour of duty calling for restraining a subsequent prisoner.)

3. The flexibility of the advantageous symmetrical strap configuration enables a second restraint strap 12 to be slipped through a loop 41 or 43 on a first prisoner or to be passed around the bridging strip 21, thus shackling a second prisoner to a first prisoner. Or, a second restraint strap 12 can be placed around the ankles of a prisoner or around an anchoring object. Multiple prisoners can be strung together by employing multiple restraint straps, and so forth thereby providing great flexibility and great adaptability in uses by law enforcement officers as a variety of circumstances may evolve. Thus, there is an ease for multiple subjects being restrained and moved.

4. The dual-loop strap restraint being symmetrical about both a transverse centerline axis and a longitudinal center line axis is easy to use, being reversible end-for-end and also being invertible so that the inserted parallel ends 15, 30 and 17, 30 can extend downwardly or upwardly, as may be desired. Thus, there is an ease and convenience of application.

5. The straight, flexible strap shape 12 enables a neat bundle of a dozen or so of them to be carried, for example wrapped around an officer's waist supported in a carrying sleeve affixed to a belt. Alternatively, a bundle of them can be slung over a shoulder or slug from a belt like a sword, and so forth.

6. Instead of carrying dual-loop strap restraints as straight straps, the officer may carry one or more of them in prepared shape, ready for quickly and safely securing a prisoner upon apprehension. In order to carry them in this prepared (pre-set) shape, the tips 15 and 17 are inserted only a short distance into the respective openings 22 and 24 of the socket clasps 18 and 20, thus forming two loops interconnected by the bridging portion 21. Consequently, the resulting loops will be larger than the loops 41 and 43 (FIG. 2) since the tips 15 and 17 have been inserted only a short distance into their respective sockets. Then, the bridging portion 21 is bent back on itself in a U-bend at the centerline 19, so that the two loops are positioned aligned with each other one on top of the other in a relatively compact overall double loop shape, which can conveniently be tucked into the officer's belt or into a large pocket. Several sets of these prepared or pre-set dual-loop strap restraints can readily be carried by an officer. During the securing of a prisoner, the officer quickly reduces the size of the previously prepared larger loops so as to fit snugly around the prisoner's wrists or ankles.

7. The flexibility of the loops 41 and 43 adapts to the shape of the limb of the restrained person, in contradiction to a rigid metal handcuff.

8. This dual-loop la enforcement strap restraint does not need any key for removal, being inexpensive and disposable it is merely cut or snipped off for removal.

9. Since there is no exchanging of handcuffs during transfer of custody of a prisoner, there is less occurrence of body contact between an officer and a prisoner, and so there is reduced risk of an officer's contracting any disease with which the prisoner might be infected.

10. Since there is no exchanging of handcuffs, there is no chance of transferring an infection from one prisoner to the next. This dual-loop symmetrical strap restraint 10 is used only once and then is disposed of.

11. A wide variety of sizes and shapes of loop configurations 41 and 43 can be created as may be appropriate, whereas, a metal handcuff is rigid and thus is considerably more limited in adjustability.

12. Since the bridging portion 21 of the strap which spans across between the two socket clasps is stiffly flexible, the two loops 41 and 43 are enabled to become configured closely to the two limbs of a person when the looped portions 40 and 42 are drawn snug, thereby affording secure restraint together with some degree of compliant comfort for the restrained person.

In order to provide an even more detailed appreciation for the illustrative embodiment of the present invention, some specific illustrative examples will now be described.

For example, in particular preferred embodiments the particular length "L" of the straight integral strap 12 with its integral sockets clasps 18 and 20 is in the range from 32 to 38 inches. The spacing "S" between the inside edges of the mesial portions 23 of the respective socket clasps 18 and 20 is in the range from about 0.75 of an inch to about 1.25 of an inch, and is shown with the spacing S being about 1.00 inch, and thus each distance "D" from the transverse centerline axis 19 is about 0.50 of an inch. This spacing S is made as reasonably small as possible while still leaving sufficient clearance between the loops 41 and 43 for enabling an officer conveniently to insert a second tapered end 30 after a first tapered end has been inserted and the first extremity has been pulled into a snug loop. The plastic material forming the strap 12, including the bridging portion 21 and the socket clasps is tough, stiffly flexible, cuttable and snippable and has sufficient tensile strength to resist and prevent being pulled apart or ruptured by a very strong person.

As shown in FIG. 5, each socket clasp has a longitudinal dimension "X" (in the long direction of the strap centerline axis 25) of about one-half of an inch and a transverse width "S" (in the direction parallel with the transverse centerline axis 19) of about ⅝ths of an inch. As shown in FIG. 3, each socket clasp has a height "H" of about ½ of an inch. Each latch stop 26 or 28 is inclined downwardly for example, at an acute angle to the horizontal as seen in FIG. 3 at an angle in the range from about 24° to about 34°, for example, preferably about 26° to 27°. The flat ratchet face 48 is canted at an angle "A" to the length of the steel strip, where A is for example, in a range from about 30° to about 45°, for example being about 38° to about 40°.

The friction grip length "F" is described in detail above, being in the range from about one inch to about 2 ½ inches and preferably is about 1 ½ to about 2 inches.

The tapered end portion 30 has a length in the range of about 1 ½ to about 2 inches and preferably is about 1 ¾ inches long. The extremities 14 and 16 of the strap 12 as seen in FIG. 4A have a width "N" in the range of about 5/16ths to about 11/32nds of an inch and has a thickness "T" of about ⅛th of an inch. The saw-toothed, channel-shaped top surface 34 is straddled by a pair of laterally spaced parallel rounded rims 50. The saw-tooth ridges 36 are evenly spaced along the strap length by a ridge-to-ridge spacing of about 5/32nds of an inch. As shown in FIG. 3 by the dimension "Y" these saw-toot ridges 36 are absent from smooth portions 52 of the strap 12 near the distal side of each latch socket 18 and 20. For example, each smooth portion 52 of strap 12 has a length Y of about six inches. The apex of each ridge 36 is located just slightly below the tops of the parallel rims 50 by a small amount of about 1/64th of an inch, as seen in FIG. 4A. These rims 50 advantageously guide the latch stop 26 or 28 for keeping it squarely aligned with the center-line axis 25 of the strap, thus keeping the ratchet face 48 squarely aligned with the ridges 36 over which it is ratcheting as the extremity of the strap is being pulled through the socket opening 22 or 24. The latch stop strip, as seen in FIG. 5 has a width "M" of about 1/32nd of an inch less than the spacing between the parallel rims 50. The valleys between the ridges 36 have a depth of about 3/64ths of an inch, leaving a thickness "T" of about 1/16ths of an inch for the bottom portion 38 of the strap, and the rims 50 also have a transverse thickness of about 1/16th of an inch.

The socket clasp opening 22 or 24 has a size about 1/64th of an inch larger n each direction than the strap extremity to be inserted therein.

Since other changes and modifications varied to fit particular operating requirements and environments will be understood by those skilled in the art, the invention is not considered limited to the foregoing presently preferred examples chosen for purposes of illustration of the best modes currently contemplated for putting this invention into practice, and thus this invention includes all changes and modifications which do not constitute a departure from the true spirit and scope of this invention as claimed in the following claims and equivalents thereto.

What is claimed is:

1. A two-interconnected-loop forming disposable law enforcement restraint wherein each loop is adapted to encircle a limb of a person to be restrained, said restraint comprising:

a stiffly flexible, elongated, integral, tough plastic strap having strong tensile strength for resisting being manually pulled apart, said strap having two ends and having a center located mid-way between said ends, each of said two ends being shaped for ease of insertion into an opening, said strap having two extremities, a respective one of said extremities being contiguous with a respective associated shaped end and extending inwardly from its associated shaped end toward said center, a pair of socket clasps integral with said strap and each being located near said center, each socket clasp having an opening extending through the socket clasp, latching means operatively associated with said opening for permitting a strap extremity to be drawn through the opening of a socket clasp in a first direction and for preventing the strap extremity from being withdrawn through the opening of the socket clasp in a second direction opposite to said first direction, each extremity of the strap being sufficiently flexible for allowing the strap extremity to be flexibly bent into a loop with its associated shaped end being inserted completely through the opening of a socket clasp in said first direction for pulling on the shaped end for drawing the strap extremity through the opening in said first direction for snugging a loop formed by the flexibly bent strap extremity around a limb encircled by the loop, whereby said latching means prevents either strap extremity from being withdrawn from the opening of the socket clasp through which the extremity has been drawn, thereby forming two secure loops restraining two limbs of a person around which respective loops have been snugged, and said strap extremities being cuttable for opening the loops for removal of the restraint, which is thereafter to be disposed of.

2. A two-interconnected-loop-forming law enforcement restraint as claimed in claim 1, in which:

each strap extremity has a broad, shallow U-shaped cross-sectional configuration defining a pair of laterally spaced parallel rims, a multiplicity of ridges extend transversely across each strap extremity between said rims, said ridges are substantially uniformly spaced along the length of the strap extremity, each of said ridges has an abrupt mesial face and a sloping distal face, said latching means include a resiliently deflectable latch stop projecting into the opening of the socket clasp and being inclined in said first direction for riding over the ridges in ratchet fashion as a strap extremity is drawn through the opening in said first direction, and said resiliently deflectable latch has a ratchet end which contacts and abrupt mesial face of a ridge for preventing the strap extremity from being withdrawn through the opening in said second direction.

3. A two-interconnected-loop-forming law enforcement restraint as claimed in claim 2, in which:

said ratchet end of said resiliently deflectable latch stop is sufficiently narrow to fit closely between said parallel rims of a strap extremity, each of said ridges extending transversely across each strap extremity between said rims has an apex positioned slightly below said rims, and successive ridges define a valley between them and the valleys are positioned more deeply below said rims than the apexes of the ridges, whereby the laterally spaced parallel rims provide a channel for guiding the resiliently deflectable latch stop in riding over the ridges as a strap extremity is drawn through the opening in said first direction and for guiding the ratchet end into a valley for contacting an abrupt mesial face of a ridge for preventing the strap extremity from being withdrawn through the opening in said second direction.

4. A two-interconnected-loop-forming law enforcement restraint as claimed in claim 1 in which:

each of said socket clasps has a mesial portion defining a side of the socket clasp facing toward the center of the strap, a bridging portion of the strap integral with said mesial portions spans across between said mesial portions, and said bridging portion of the strap is stiffly flexible for enabling the two loops when snugged around two limbs of a person to become relatively oriented in close conformance to said limbs for affording secure restraint together with some degree of compliant comfort for the restrained person.

5. A two-interconnected-loop-forming law enforcement restraint as claimed in claim 4, in which:

each of said resiliently deflectable latch stops is a spring strip, and the respective spring strip is inserted into the respective mesial portion of a socket clasp and is projecting into the opening of the socket clasp and is inclined downwardly in said first direction.

6. A two-interconnected-loop-forming law enforcement restraint as claimed in claim 1, in which:

said strap and said pair of socket clasps integral with said strap are symmetrical about a longitudinal axis of the strap, and said strap and said pair of socket clasps integral with said strap are symmetrical about a transverse axis extending through said center, whereby the restraint is convenient to apply, because it can be reversed end-for-end without changing its operation.

7. A two-interconnected-loop-forming law enforcement restraint as claimed in claim 1, in which:

each strap extremity includes a saw-tooth pattern defining a multiplicity of abrupt mesial faces spaced substantially uniform along the length of the strap extremity with sloping distal faces between successive abrupt mesial faces, and said latching means include two resiliently deflectable spring strips, a respective one of said strips projecting into the respective socket clasp opening.

8. A two-interconnected-loop-forming law enforcement restraint as claimed in claim 7, in which:

each of said socket clasps has a mesial portion defining a side of the socket clasp facing toward the center of the strap, a bridging portion of the strap integral with said mesial portions of the socket clasp, spans across between said mesial portion, and said bridging portion of the strap is stiffly flexible for enabling the two loops snugged around two limbs of a person being restrained to become oriented relative to each other for conforming closely to said two limbs for providing secure restraint while also providing some degree of compliant comfort for the restrained person.

9. A two-interconnected-loop-forming law enforcement restraint as claimed in claim 8, in which:

the respective spring strip is inserted into the respective mesial portion of a socket clasp and projects into the opening of the socket clasp with downward inclination in said first direction for riding over said saw-tooth pattern in ratchet fashion as the strap extremity is drawn through the opening of the socket clasp for snugging a loop formed by the strap extremity, and said saw-tooth pattern is on an outwardly facing surface of the strap extremity relative to the loop formed by the strap extremity, whereby said saw-tooth pattern faces outwardly away from a restrained limb encircled by said loop.

10. A two-interconnected-loop-forming law enforcement restraint as claimed in claim 1, in which:

the overall length "L" of said strap is in the range from about 34 to about 38 inches.

11. A two-interconnected-loop-forming law enforcement restraint as claimed in claim 1, in which:

the spacing "S" between mesial portions of the respective sockets clasps is in the range from about 0.75 of an inch to about 1.25 of an inch.

12. A two-interconnected-loop-forming law enforcement restraint as claimed in claim 11, in which:

a bridging portion of the strap extends between mesial portions of the respective socket clasps and is integral with said mesial portions and i stiffly flexible for allowing two loops formed by the strap extremities snugged around respective two limbs of a person to become relatively oriented into close conformance with said two limbs for providing secure restraint while affording some degree of comfortable compliance with the limbs.

13. A two-interconnected-loop-forming law enforcement restraint as claimed in claim 1, in which:

the strap has a longitudinal axis, and the openings extending through the socket clasps are oriented substantially perpendicular to said longitudinal axis of the strap and are oriented substantially parallel with each other.

14. A two-interconnected-loop-forming law enforcement restraint as claimed in claim 13, in which:

said latching means permit the strap extremities to be drawn through said substantially parallel openings in the same first direction substantially parallel with each other for enabling two loops to be formed in symmetrical relationship.

15. A law enforcement restraint for forming a double loop attachment to arms or legs of a restrained person comprising a single, elongated, substantially flat strap having first and second longitudinally extending strap extremities, first and second socket clasps spaced longitudinally of said strap and being located in said strap between said first and second extremities, said first and second socket clasps each having an opening therethrough extending substantially perpendicular to the plane of said elongated strap, each of said openings being adapted to receive and retain a respective one of said extremities, when the respective extremity is looped into inserted relationship through an opening in a socket clasp, each extremity being sufficiently flexible for being looped into such inserted relationship through an opening of a socket clasp, whereby respective end portions of said first and second extremities project parallel to each other after insertion through said first and second socket clasps, and ratchet means in each of said openings for allowing an extremity to be inserted through an opening in an insertion direction and to be moved further through the opening in said insertion direction and for preventing a fully inserted extremity from being moved through the opening in an extraction direction opposite to said insertion direction, whereby a respective extremity can be looped around a limb of a person to be restrained with the extremity being drawn snugly around the limb in inserted relationship through an opening of a socket clasp, forming a dual-loop attachment around two limbs, and thereby said ratchet means will hold such looped extremity in snug relationship around the respective limb for securely restraining two limbs of a person.

16. A law enforcement restraint as claimed in claim 15, in which:

said strap has a transverse centerline and is symmetrical about said transverse centerline for advantageously enabling said strap to be reversed end-for-end without changing its functional operation.

17. A law enforcement restraint as claimed in claim 15, in which:

a short length of said strap spans between said first and second socket clasps for interconnecting said socket clasps, and said shot length is flexible for allowing the dual loop attachment to conform with the configuration of the restrained person.

18. A law enforcement restraint as claimed in claim wherein:

said first and second strap extremities are cuttable and each has a saw-toothed surface whose saw-tooth shaped teeth have abrupt mesial faces.

said abrupt mesial faces on each respective strap extremity all face toward a central part of said strap, and said ratchet means in each opening include a deflectable sloping stop extending into the opening and sloping in the same direction as sloping distal surfaces on said teeth for permitting said stop to ride over said teeth in an insertion movement of a strap extremity in said opening and preventing movement in the opposite direction, thereby providing a dual-loop restraint with the size of the loops being adjustable toward smaller and resisting enlargement, whereby the restraint is removed by cutting the strap extremities and is then disposable.

19. A law enforcement restraint as claimed in claim 18 wherein:

said first and second extremities are tapered at their respective ends and have smaller teeth near the tapered end to facilitate insertion and pulling the first and second extremities through the respective openings in said first and second socket clasps.

20. A law enforcement restraint as claimed in claim 18, wherein:

said first and second strap extremities are channel shaped as seen in cross section defining a pair of laterally spaced parallel rims, and said saw-tooth shaped teeth are located between said parallel rims.

* * * * *